US008337002B2

(12) United States Patent
Akiyama et al.

(10) Patent No.: US 8,337,002 B2
(45) Date of Patent: Dec. 25, 2012

(54) INK EJECTION HEAD UNIT AND IMAGE FORMING APPARATUS

(75) Inventors: Yoshitaka Akiyama, Atsugi (JP); Hirotaka Kobayashi, Tokyo (JP); Mitsuru Kawakami, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 367 days.

(21) Appl. No.: 12/816,931

(22) Filed: Jun. 16, 2010

(65) Prior Publication Data

US 2010/0328408 A1 Dec. 30, 2010

(30) Foreign Application Priority Data

Jun. 26, 2009 (JP) ..... 2009-152827

(51) Int. Cl.
*B41J 2/175* (2006.01)

(52) U.S. Cl. ..... 347/89; 347/85

(58) Field of Classification Search ..... 347/66, 347/67, 85, 89
See application file for complete search history.

(56) References Cited

U.S. PATENT DOCUMENTS

| | | | | |
|---|---|---|---|---|
| 4,896,172 | A * | 1/1990 | Nozawa et al. | 347/17 |
| 5,291,215 | A * | 3/1994 | Nozawa et al. | 347/18 |
| 5,818,482 | A | 10/1998 | Ohta et al. | |
| 6,231,174 | B1 * | 5/2001 | Haigo | 347/89 |
| 6,328,418 | B1 | 12/2001 | Yamada et al. | |
| 6,331,052 | B1 | 12/2001 | Murai et al. | |
| 6,517,189 | B2 | 2/2003 | Ogawa et al. | |
| 6,719,411 | B2 | 4/2004 | Tomita et al. | |
| 6,742,882 | B2 * | 6/2004 | Nakamura | 347/89 |
| 6,761,436 | B2 | 7/2004 | Tobita et al. | |
| 6,843,554 | B2 | 1/2005 | Nagata et al. | |
| 6,918,180 | B2 | 7/2005 | Koda et al. | |
| 7,077,511 | B2 | 7/2006 | Machida et al. | |
| 7,090,325 | B2 | 8/2006 | Hashimoto et al. | |
| 7,090,340 | B2 | 8/2006 | Tobita et al. | |
| 7,131,718 | B2 | 11/2006 | Matsufuji et al. | |
| 7,163,279 | B2 | 1/2007 | Shimizu et al. | |
| 7,413,294 | B2 | 8/2008 | Tobita et al. | |
| 7,478,898 | B2 | 1/2009 | Yamada et al. | |
| 7,494,210 | B2 | 2/2009 | Yamada et al. | |
| 7,556,367 | B2 * | 7/2009 | Langford et al. | 347/89 |
| 7,731,861 | B2 | 6/2010 | Hashimoto et al. | |
| 2004/0174411 | A1 | 9/2004 | Sumiya et al. | |

(Continued)

FOREIGN PATENT DOCUMENTS

JP 2002-86748 3/2002

(Continued)

*Primary Examiner* — Anh T. N. Vo
(74) *Attorney, Agent, or Firm* — Cooper & Dunham LLP

(57) ABSTRACT

An ink ejection head unit includes a head that ejects ink drops from plural two nozzles. The head includes a common liquid chamber connected to the plural nozzles. The common liquid chamber has a supply opening and an ejection opening. A tank is connected to the head and includes an ink containing section that contains ink to be supplied to the head. Also included is a supply path to supply the ink from the ink containing section to the supply opening of the head. An ejection path is provided to eject the ink ejected from the ejection opening of the head to an outside of the ink ejection head unit. A communication path is also provided to communicate the highest section of a seal of the containing section with the ejection path higher than the highest section of the seal. A fluid resistance of the communication path is larger than the total fluid resistance of a path starting from the supply opening to the ejection opening.

11 Claims, 9 Drawing Sheets

U.S. PATENT DOCUMENTS

| | | | |
|---|---|---|---|
| 2006/0044364 | A1 | 3/2006 | Tobita et al. |
| 2006/0197809 | A1 | 9/2006 | Tobita et al. |
| 2006/0268072 | A1 | 11/2006 | Yamada et al. |
| 2007/0132813 | A1 | 6/2007 | Yamada et al. |
| 2007/0195130 | A1 | 8/2007 | Koda et al. |
| 2008/0291232 | A1 | 11/2008 | Yamada et al. |
| 2008/0303884 | A1 | 12/2008 | Miura |
| 2008/0316280 | A1 | 12/2008 | Yamada et al. |
| 2009/0102907 | A1 | 4/2009 | Yamanaka et al. |
| 2009/0244202 | A1 | 10/2009 | Kida et al. |

FOREIGN PATENT DOCUMENTS

| | | |
|---|---|---|
| JP | 2005-14342 | 1/2005 |
| JP | 2005-81744 | 3/2005 |
| JP | 2007-76093 | 3/2007 |
| JP | 2008-143027 | 6/2008 |
| JP | 2008-213196 | 9/2008 |
| JP | 2009-12244 | 1/2009 |

* cited by examiner

INK EJECTION HEAD UNIT AND IMAGE FORMING APPARATUS

CROSS-REFERENCE TO RELATED APPLICATIONS

This application claims priority under 35 USC §119 to Japanese Patent Application No. 2009-152827 filed on Jun. 26, 2009, the entire contents of which are hereby incorporated by reference.

BACKGROUND OF THE INVENTION

1. Field of the Invention

The present invention relates to a ink ejection head unit for ejecting ink drops and an image forming apparatus, such as a printer, a facsimile, a copier, a plotter, a multiple function machine, etc., having the ink ejection head unit.

2. Discussion of the Background Art

An image forming apparatuses using a liquid ejection printing system, ink jet printing apparatuses that eject ink drops and form an image on a sheet conveyed are well known. Such image forming apparatuses are of two types: A serial type, in which a printing head ejects ink drops while moving in a main scanning direction, and a line type, in which a printing head ejects ink drops without moving in the main scanning direction.

In either case, an ink supplying system included in an ink jet printing apparatus typically includes a main tank and a sub tank in a printing head and an apparatus body, respectively. Specifically, ink is replenished from the main to sub tanks, and the sub tank supplies the ink to the printing head.

In such an ink supply system, there are provided a supply tube for supplying the ink from the main to sub tanks and a flexible film-like member or membrane serving as a damper for keeping a constant pressure in the sub tank. However, into those devices air gradually penetrates as time elapses, eventually accumulating in the sub tank. Further, when the main tank is attached or detached, a small amount of air also enters the system and is ultimately supplied to the sub tank together with the ink.

To counteract the above-mentioned tendencies, Japanese Patent Application Laid Open No. 2002-86748, a conventional sub tank that includes an ink chamber that deforms in accordance with an ink amount stored therein while maintaining negative pressure. The ink chamber includes separate ink introduction and air evacuation sections at its upper section and an ink supply section at its lower section. The ink introduction section is elastic and includes a replenishment valve system having a valve seat having an ink introduction path, a valve body, and an elastic member for pressing the valve body against the valve seat so as to shut off the ink introduction path. In the evacuation section, there is provided an elastic sealing system having a closed slit at its center.

Thus, the sub tank can suppress accumulation of the air therein by separately providing the ink induction path from the air evacuation section and evacuating the air therefrom.

However, since the slit is made of elastic material, the sub tank does not contribute to improving air tightness of the air evacuation section.

As a result, when the ink chamber enters a negative pressure state, air tends to slip in through the slit.

Further, Japanese Patent Application Laid Open No. 2005-014342 discloses a system that includes an atmosphere open valve for communicating a container of a sub tank with atmosphere.

However, if foreign matter invades and is attracted thereto during either assembly or usage of the valve body and the valve seat of the atmosphere open valve system, a gap appears and an air-tight state cannot be maintained. As a result, air invades the sub tank through the atmosphere open mechanism.

SUMMARY OF THE INVENTION

Accordingly, an object of the present invention is to improve such background art technologies and provides a new and novel ink ejection head unit. Such a new and novel ink ejection head unit includes a head that ejects ink drops from plural two nozzles. The head includes a common liquid chamber connected to the plural nozzles. The common liquid chamber has a supply opening and an ejection opening. A tank is connected to the head and includes an ink containing section that contains ink to be supplied to the head. Also included is a supply path to supply the ink from the ink containing section to the supply opening of the head. An ejection path is provided to eject the ink ejected from the ejection opening of the head to an outside of the ink ejection head unit. A communication path is also provided to communicate the highest section of a seal of the containing section with a section of the ejection path higher than the highest section of the seal. A fluid resistance of the communication path is larger than the total fluid resistance of a path starting from the supply opening to the ejection opening of the head.

In another aspect, the highest section of the seal is located substantially at a center of the tank.

In yet another aspect, the highest section of the seal includes an air bubble accumulation section that accumulates air bubble.

In yet another aspect, the ink containing section includes a filter that filters the ink taken in from an outside, an ink accumulation section that accumulates the ink filtered by the filter, and an ink supply path extending from the ink accumulation section to the supply path. The ink accumulation section, the ink supply path, and the ejection path partially include elastic walls, respectively.

In yet another aspect, an image forming apparatus includes a housing, and an image formation device that has the ink ejection head unit.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
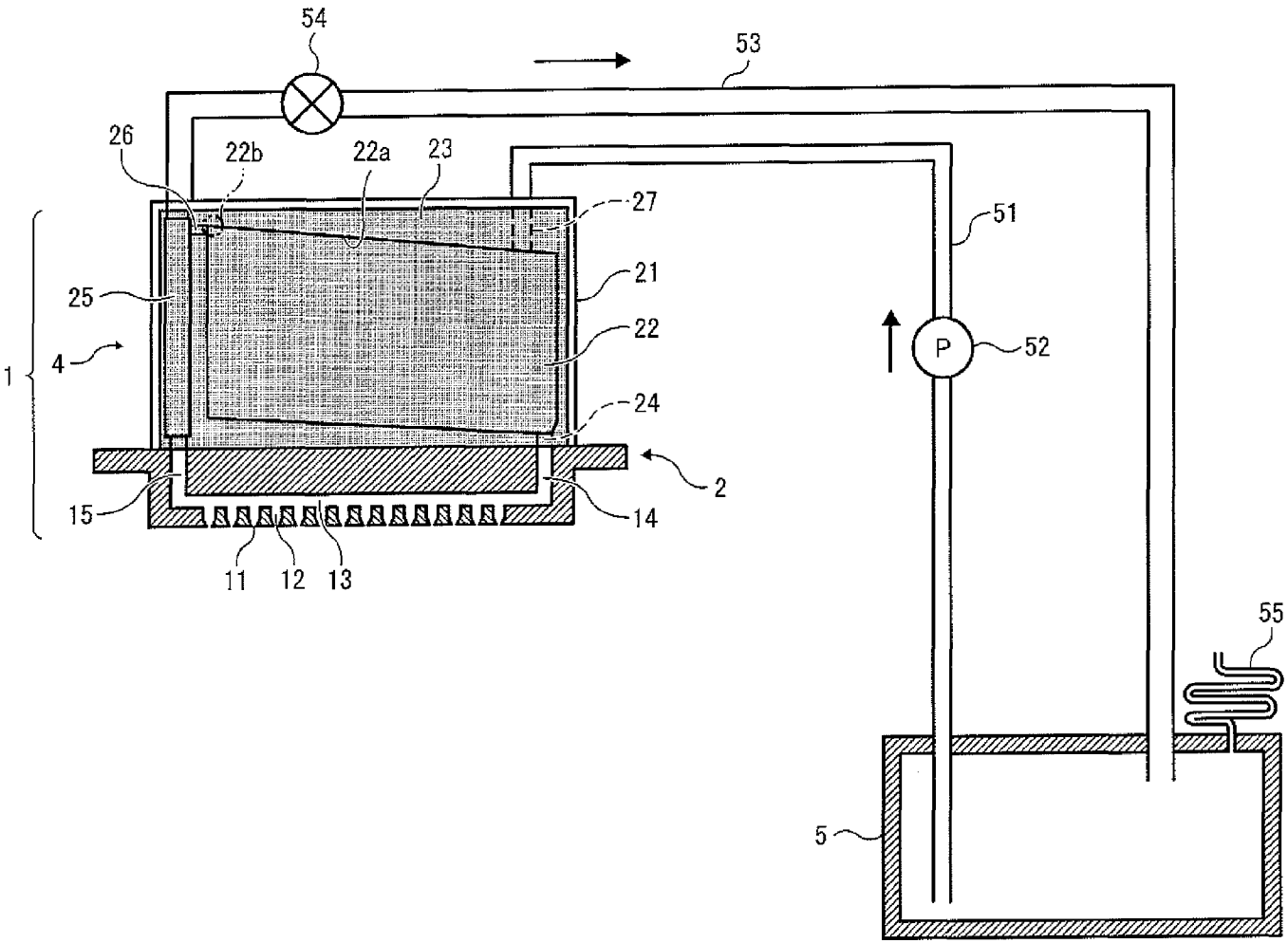
FIG. 1 illustrates an exemplary ink supply system that includes an ink ejection head unit according to the first embodiment of the present invention.

Referring now to the drawing, wherein like reference numerals designate identical or corresponding parts throughout several views, in particular in FIG. 1, a first embodiment of the present invention is described. As shown, an ink ejection head unit 1 is provided and includes a head 2 for ejecting ink drops, and a sub tank 4 for supplying ink to the head 2.

The head 2 includes plural nozzles 11 for ejecting ink drops, liquid chambers 12 communicated with the respective nozzles 11, a common liquid chamber 13 for supplying ink to respective liquid chambers 12, a supply opening section (e.g. an ink supply port) 14 arranged at one end of the head 2 for taking in and supply the ink into the common liquid chamber 13, and an ejection opening section (e.g. an ink ejection port) 15 arranged on the other end of the head 2 for ejecting the ink from the common liquid chamber 13 or the like.

The sub tank 4 also includes a tank casing 21, an ink container section 22 installed in the tank casing 21 for containing ink to be supplied to the head 2, a supply path 24 for supplying ink from the ink containing section 22 to the ink supply port 14 of the head 2, an ejection path 25 for ejecting the ink ejected from the ink ejection port 15 of the head 2 to an outside, and a communication path 26 for communicating the ink containing section 22 with the ejection path 25. A slant seal surface 22*a* is formed in the ink containing section 22. The communication path 26 communicates the highest section 22*b* of the seal surface 22*a* with a portion of the ejection path 25 higher than the highest section 22*b* of the seal surface 22*a*. Further, fluid resistance on the communication path 26 is larger than that on the path between the ink supply port 14 and the ink ejection port 15.

The sub tank casing 21 includes an opening at its one side, to which an elastically deformable film member 23 is adhered to absorb pressure change in the tank by its deforming as illustrated by mesh in the drawing. Further, an ink supply flow channel opening section 27 is provided in the ink containing section 22.

Whereas a replaceable main tank 5, such as an ink cartridge, etc., is arranged on the apparatus body side to replenishment ink to the sub tank 4. An ink supply pump 52 is provided and conveys ink from the main tank 5 to sub tank 4 through the ink supply path 51. Further, the ejection path 25 is connected to the main tank 5 via an ink return path 53 that includes an intervening open/close valve 24.

Further, the main tank 5 includes an atmosphere opening tube capable of preventing ink stored therein being exposed for a long time and thereby either drying or coagulating. Specifically, a flow channel of the atmosphere opening tube 55 has a long slender tube so that humidity therein changes in accordance with a length thereof and the ink therein can prevent direct contact to the ambient.

Further, the ink contained in the sub tank 4 is supplied to one end of the common liquid chamber 13 via the supply path 24 and the ink supply port 14. The ink supplied to the common liquid chamber 13 and not used in liquid drop ejection is returned to the main tank 5 through the ink ejection port 15, the ink ejection path 25, and the ink return path 53. Specifically, they collectively form a circulation path. Thus, an ink flow channel extending over the ink return path 53 and the main tank 5 may be shut off by an open/close valve 54.

Figure 2:
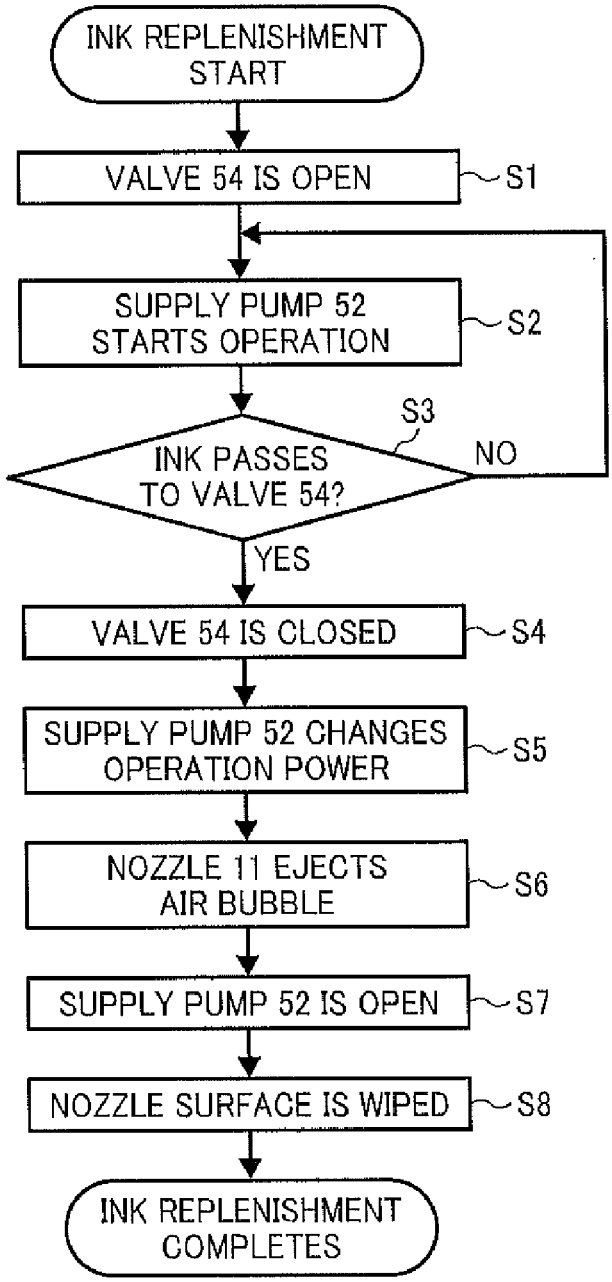
FIG. 2 illustrates an exemplary sequence of an ink replenishment operation executed in the ink supply system.

Now, an exemplary sequence of replenishment of the head 2 with ink executed in the above-mentioned ink system is described with reference to FIG. 2. Initially, the valve 54 is open, and the ink supply use pump 52 conveys the ink from the main tank 5 to sub tank 4 through the ink supply path 51. The ink flows from an ink supply flow channel opening 27 provided in the sub tank 4 into the ink containing section 22 and partially further flowing into the head 2. Air bubble mixed in the ink containing section 22 is evacuated to the ink ejection path 25 through the communication path 26. Thus, ink replenishment into the ink containing section 22 starts. Then, the ink contained in the ink containing section 22 is replenished up to the highest level 22*b* of the seal surface 22*a* and reaches to the ink ejection path 25 through the communication path 26.

Further, the ink conveyed to the head 2 is then conveyed to the common liquid chamber 13 through the ink supply port 14. The ink flown into the common liquid chamber 13 is partially ejected from respective nozzles 11. Further, the ink in the common liquid chamber 13 flows to the ink ejection path 25 via the ink ejection port 15, and flows together with the ink from the communication path 26. The ink is further conveyed to the ink return path 53 and finally returns to the main tank 5.

When the ink conveyed into the ink return path 53 passes through the valve 54, the valve 54 is closed. Then, pressure in the ink supply use pump 52 is appropriately adjusted, so that the ink is ejected outside from the nozzles 11, whereby air bubble in the nozzles 11 is ejected. Further, the ink supply use pump 52 is open, and thereby ink flow is stopped, so that negative pressure necessary for preparation of ink ejection is created by a difference of water head between the main tank 5 and the nozzles 11.

Then, a wiper member, not shown, made of an elastic member, such as preferable silicon, etc., wipes the nozzle surface and removes ink drooping therefrom. The wiper member thereby causes the nozzle 11 to form meniscus, thereby the ink replenishment thereto is completed.

In this way, since the ink is always supplied to replenish the head 2 from the main tank 5 through the sub tank 4, the head can be ready to eject the ink.

Figure 3:
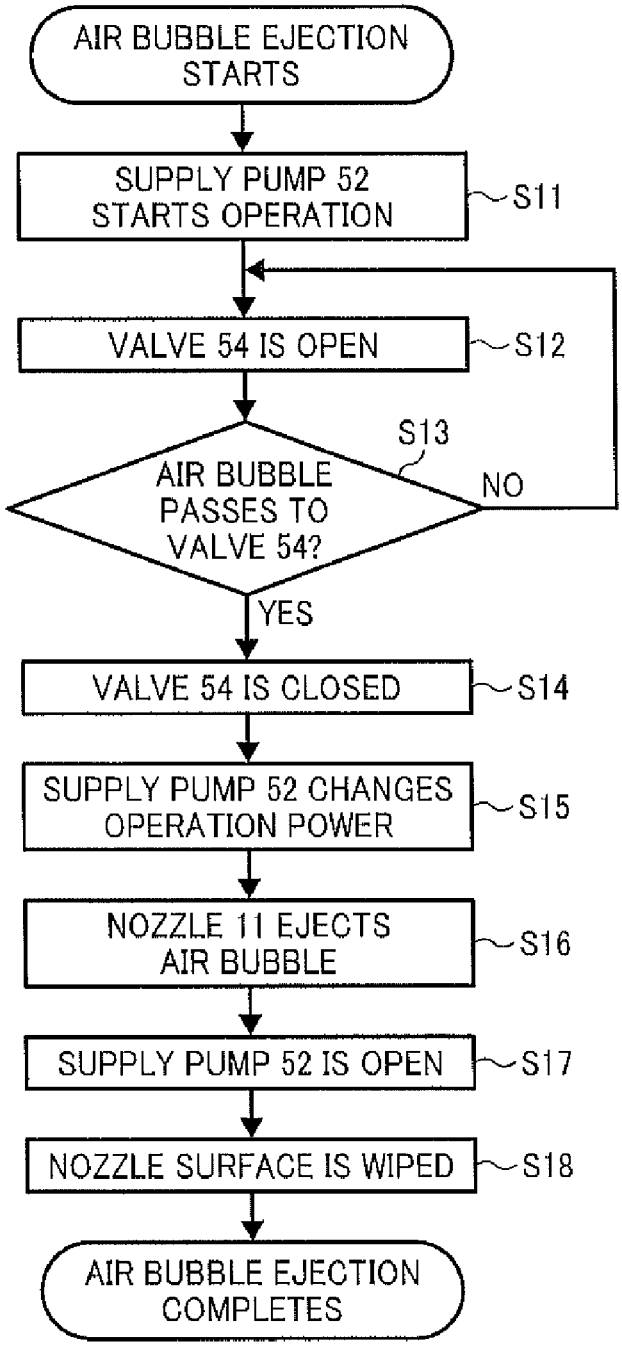
FIG. 3 illustrates an exemplary sequence of an air bubble evacuation operation.

Now, an exemplary sequence of evacuating mixed in air bubble from the ink supply system is described with reference to FIG. 3. Specifically, the air bubble can mix in the respective ink flow channels and the ink containing section 22, for example, when ink is used up and the main tank 5 is replaced to replenishment ink. Otherwise, the air bubble mixes in for some reason from the nozzles 11. As a result, liquid drop ejection likely causes a problem. To resolve, the problem, the above-mentioned air bubble evacuation is executed.

Specifically, the ink supply use pump 52 conveys ink, initially, and the valve 54 is immediately open. Thus, the ink flows from the ink supply flow channel opening 27 into the ink containing section 22. Thus, when being mixed in the ink supply path 51, the air bubble flows together into the ink containing section 22 and accumulates in the upper section of the ink containing section 22. Further, the ink containing section 22 is pressurized by the ink conveyed thereto, and accordingly, the air bubble accumulating in the upper section is evacuated from the communication path 26 to the ink ejection path 25. At same time, even when the ink is further conveyed to the head 2 from the ink containing section 22 and air bubble is mixed in the common liquid chamber 13, the air bubble is also evacuated to the ink ejection path 25. The ink flowing together with the other ink on the ink ejection path 25 is further conveyed to the ink return path 53, and is finally returned to the main tank 5.

When the air bubble mixed in with the liquid is entirely conveyed to the downstream section of the valve 54, the valve 54 is closed. Then, pressure in the ink supply use pump 52 is appropriately adjusted, so that the air bubble in the nozzles 11 is ejected together with the ink. Further, the ink supply use pump 52 is open, and ink flow is stopped, so that negative pressure necessary for preparation of ink ejection is created by a difference of water head between the main tank 5 and the nozzles 11. Then, a wiper member, not shown, wipes the nozzle surface 11*a* and scrapes ink drooping therefrom, whereby causes the nozzle 11 to form meniscus and the ink replenishment thereto is completed.

Thus, the air bubble mixed in the respective ink flow channels and the ink containing section 22 can be evacuated, so that a fine ink drop ejection condition can be obtained.

When air bubble in the ink supply port 14 is to be ejected from the ink ejection port 15 to the ink ejection flow channel 25, it is needed that a flow channel resistance of the communication path 26 is larger than that of a path extending over the entire head 2 (i.e., a fluid resistance between the ink supply port 14 and the ink ejection path 15). Specifically, if the flow channel resistance of the communication path 26 is smaller, a significant amount of the ink flows as is to the ink ejection path 25 via the communication path 26 and is ejected to the return path 53. As a result, an amount of the ink flown into the common liquid chamber 13 decreases and the air bubble cannot be evacuated from the head 2. Whereas when, the flow channel resistance of the communication path 26 is excessively larger than that of the entire head 2, the air bubble in the ink containing section 22 cannot be evacuated from the communication path 26.

It is confirmed through an experiment that the air bubble in the common liquid chamber 13 can sufficiently be evacuated to the ink ejection path 25 when ink has viscosity of about 3 to 25 Pa·s and a ratio between the flow channel resistance of the entire head 2 and that of the communication path 26 is from about $1/1400$ to about $1/20$. Further confirmed is that the air bubble in the ink containing section 22 can be evacuated to the ink ejection path 25.

Further, the seal surface 22*a* is slanted, and is communicated to the ink ejection path 25 by the communication path 26 at the highest section of the seal surface 22*a*. Thus, the air bubble in the ink containing section 22 mostly accumulates at the highest section of the seal surface 22*a*. Thus, by providing the communication path 26 at the highest section, the air bubble readily be evacuated from the communication path 26 to the ink ejection path 25.

Thus, with a configuration in that a tank includes an ink container section for containing ink to be supplied to a head, a supply path for supplying ink from the ink containing section to an ink supply opening section of the head, and an ejection path for ejecting the ink ejected from an ink ejection opening section of the head to an outside, and a communication path for communicating the ink containing section with the ejection path, wherein the communication path communicates the highest section of a seal surface of the ink containing section with a portion of the ejection path located higher than the highest portion of the seal surface, air bubble can be efficiently evacuated from the tank without an atmosphere open device.

Figure 4:
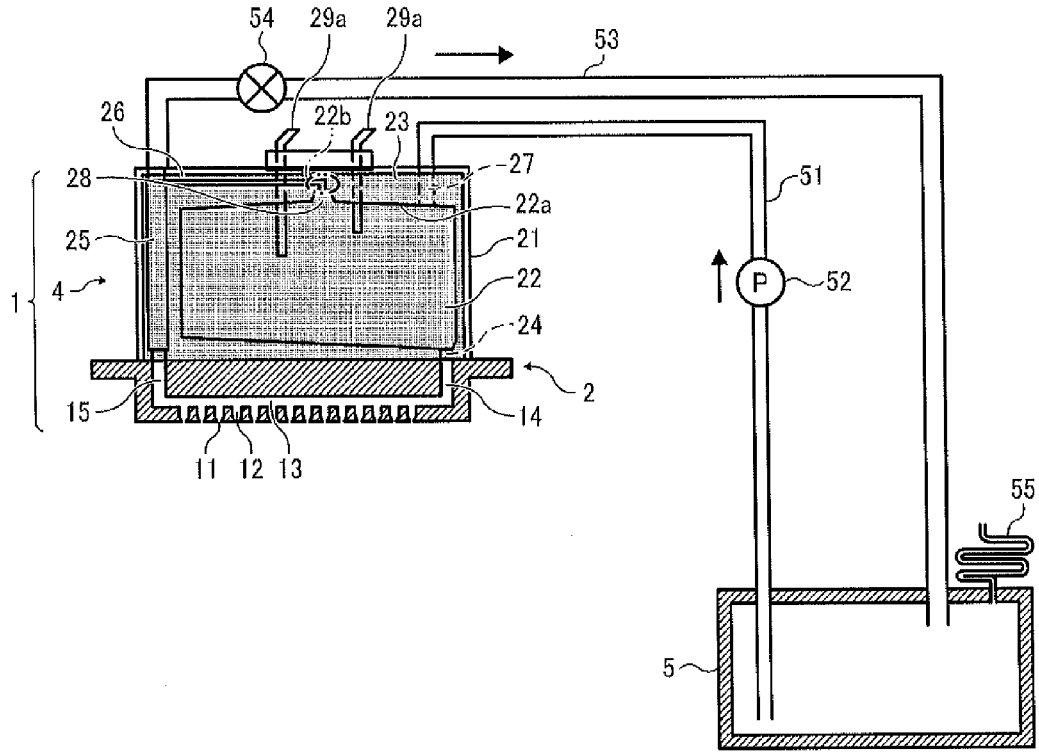
FIG. 4 illustrates an exemplary ink supply system that includes an ink ejection head unit according to the second embodiment of the present invention.

Now, a second embodiment is described with reference to FIG. 4. As shown, the seal surface 22*a* slants toward its center. The communication path 36 is arranged to communicate the highest section 22*b* of the seal surface 22*a* with the ejection path 25 located higher than the highest portion 22*b*.

Specifically, since a cubic volume of the ink containing section 22 is relatively larger than that of others, the ink flows more slowly. Thus, the air bubble sometimes remains scattering on the seal surface 22*a* not being evacuated from the communication path 26. when the inclination of the seal surface 22*a* is increased to avoid such a behavior, the cubic volume of the ink containing section 22 decreases. Further, an ink jet head and an image forming apparatus are increasingly expected to be downsized, while a number of nozzles of the head tends to increase. Thus, since a head increases a number of nozzles, ink to be supplied to the head needs to be increasingly stored in the ink containing section 22. As a result, a cubic volume of the sub tank 4 tends to increases. Thus, to downsize the head, the ink containing section 22 needs to be arranged in the sub tank as efficiently as possible.

Then, according to this embodiment, by arranging the highest portion 22*b* at the center of the seal surface 22*a* and increasing the inclination of the seal surface 22*a*, the cubic volume of the ink containing section 22 can be efficiently used while downsizing the head.

Further, an air bubble accumulation section 28 is arranged at the highest section 22*b* to accumulate air bubble. Thus, the air bubble on the seal surface 22*a* accumulates at the air bubble accumulation section 28 due to surface tension of the ink, so that evacuation of the air bubble to the ink ejection path 25 can be completed at short times. Thus, a small amount of ink is enough to be ejected from the nozzle to convey and evacuate the air bubble. Specifically, an amount of consumption ink not contributing to printing decreases. As a result, running cost decreases.

Further, a pair of detection electrodes 29*a* and 29*b* is provided in the upper section of the sub tank 4 to detect a prescribed level of ink stored in the ink containing section 22. A control section, not shown, is provided to input a detection signal to each of the tips of the detection electrodes 29*a* and 29*b* to serve as a liquid amount detection sensor. These detection electrodes 29*a* and 29*b* can detect the level by recognizing conduction condition if none of them or one of them soaks in the ink.

Thus, with the liquid amount detection sensor, conditions that ink is replenished and the ink containing section 22 is filled up, and that the air bubble is evacuated from the ink containing section 22 can be precisely detected in addition to that a prescribed amount of air bubble accumulates in the ink containing section 22.

Specifically, the liquid detection sensor can be used to complete the above-mentioned sequences as described with reference to FIGS. 2 and 3 within a short time period from when ink is replenished to the ink containing section 22 to when air bubble passes through the valve 54. Thus, ink replenishment and ejection performance executed by air bubble evacuation can be improved. The same advantage can be obtained when such a liquid detection sensor is employed in the first embodiment.

Figure 5:
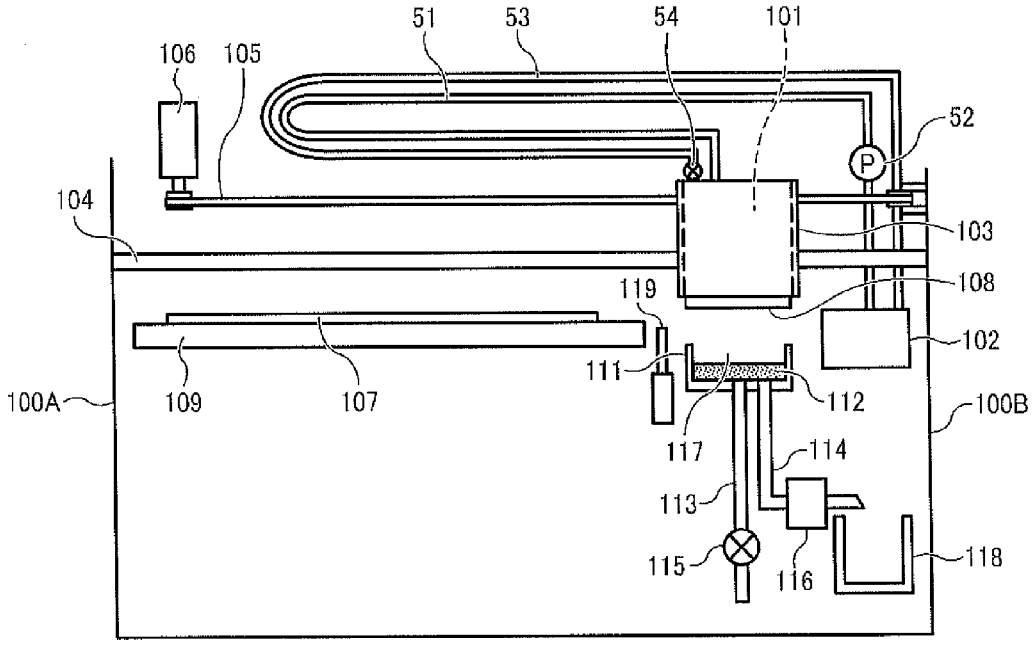
FIG. 5 illustrates an exemplary image forming apparatus according to one embodiment of the present invention.

Now, an exemplary image forming apparatus employing the above-mentioned various embodiments of the ink supply system is described with reference to FIG. 5. Specifically, the image forming apparatus includes a carriage that carries a printing head 101 having the above-mentioned ink ejection head unit thereon. The image, forming apparatus further includes left and right side plates 100A and 1008, a main guide rod 104, and a sub guide rod, not shown, to slidably support the carriage therebetween. The printing head 101 is moved by a main motor 106 via a timing belt 105 to execute scanning in a main scanning direction. At same time, a printing medium 107 is conveyed by a conveyance roller 109 in a direction perpendicular to the moving direction of the printing head 100 to oppose a nozzle surface 11*a* of the printing head 101. Then, the printing head 101 ejects and puts ink drops onto the printing medium 107 and thereby forming an image.

An ink supply pump 52 is provided and supplies ink from a main tank unit 102 having a main tank 5 and an atmosphere opening tube 55 or the like to the printing head 101 via a flexible ink supply path 51. The ink not used during ejection from the nozzle is returned to the main tank unit 102 of the printing head 101 via the ink return path 53.

Further, a cap member 111 provided outside a printer region includes an elastic cap preferably made of silicon rubber or the like that caps a nozzle surface 108 having plural nozzles 11. The printing head 101 moves above the cap member 101 when not used, and the nozzle surface 108 is capped by movement of a cap moving mechanism, not shown. An ink absorption sheet 112 is arranged in the cap member 111 to ease attraction of the ink and moisture ambient in the cap or the like.

A pair of tubes 113 and 114 is connected to a bottom surface of the cap member 111. The tube 113 is communicated to atmosphere via an atmosphere-opening valve 115. The other tube 114 is connected to the pump 116. When the cap member 111 caps the nozzle surface 108 and the pump 116 is operated while closing the atmosphere opening valve 115, negative pressure is created in the cap member 111 and the ink is sucked from the nozzle of the printing head 101. At same time, by releasing (or opening) the atmosphere-opening valve 115, the ink accumulating in the cap member 111 is ejected to a used liquid tank 118. Further, the nozzle of the printing head 101 is prevented from being dried by covering the nozzle surface 108 with the cap member 111 while closing the atmosphere-opening valve 115.

Further, a wiper blade (i.e. a wiper member) 119 is moved to a prescribed height to contact the nozzle surface 108 upwardly using a wiper movement mechanism. The wiper blade 119 then wipes off ink and dust attracting to the nozzle surface 103 by moving the printing head 101 in the main scanning direction. Thus, either a meniscus is created or cleaning is executed on the nozzle surface 108.

Figure 6:
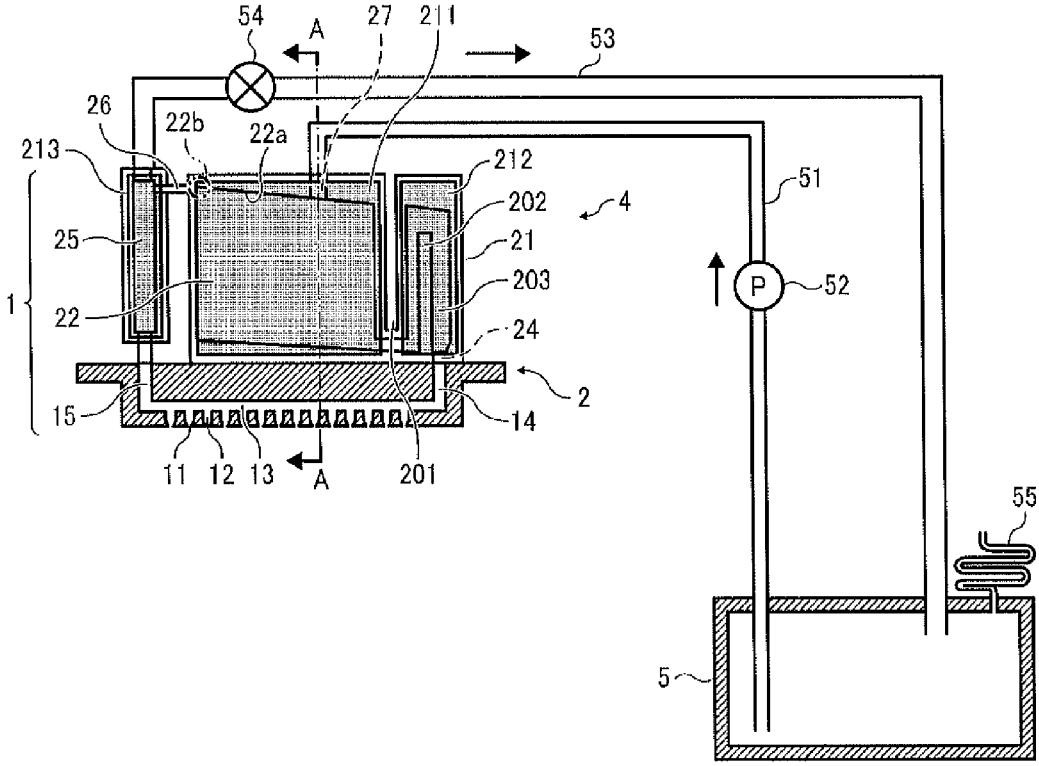
FIG. 6 illustrates an exemplary ink supply system that includes an ink ejection head unit according to the third embodiment of the present invention.
Figure 7:
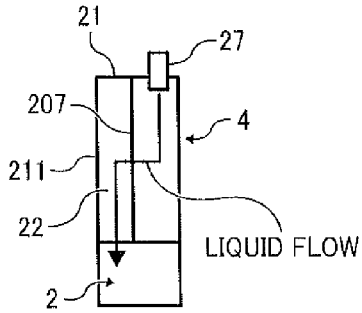
FIG. 7 illustrates an exemplary cross sectional view of the image forming apparatus of FIG. 5 along the line A-A.

Now, the third embodiment is described with reference to FIGS. 6 and 7.

As shown, the tank casing 21 includes wall sections 201 and 202 between the ink containing section 22 and the ink supply path 24. Specifically, these wall sections 201 and 202 are bent and extend from the bottom by almost the same height as the ink containing section 22 and while curving and communicating with the ink supply path 24 to collectively form a supply flow channel. Further, the tank casing 21 includes a filter 207 between the side of the ink supply, flow channel opening 27 and the supply flow channel 203 to filter the liquid. The ink flown in through the ink supply flow channel opening 27 is thus filtered by the filter 207 and is conveyed to the supply path 24 via the supply flow channel 203.

As shown, however, the ink ejection path 25 is separately arranged from the tank casing 21 of the sub tank 4.

Further, a portion of the wall surface of the ink containing section 22, that of the supply flow channel 203, and that of the ink ejection path 25 include damper members 211, 212, and 213 made of elastic material, such as a flexible film, rubber, etc., made of the same or different material with each other, respectively.

Thus, a change of pressure caused in the respective ink containing section 22, the supply flow channel 203, and the ink ejection path 25 can be absorbed or suppressed by these damper members 211 to 213, respectively. Further, when these damper members 211 to 213 use material are appropriately selected in view of vibration characteristics of the respective ink containing section 22, the supply flow channel 203, and the ink ejection path 25, vibration can be more effectively suppressed.

Specifically, the ink is restricted by a resistance when flowing from the main tank 5 and replenished into the sub tank 4 through the filter 207. Thus, replenishment of the ink becomes insufficient when an extra ordinary large amount is needed or is immediately needed due to replenishment delay. As a result, pressure changes in the head 2. However, since the portion of the wall surface of the ink containing section 22, that of the supply flow channel 203, and that of the ink ejection path 25 are formed by these dampers 211 to 213 as mentioned earlier, vibration can be either absorbed or suppressed, so that ink drop ejection becomes stable.

Figure 8:
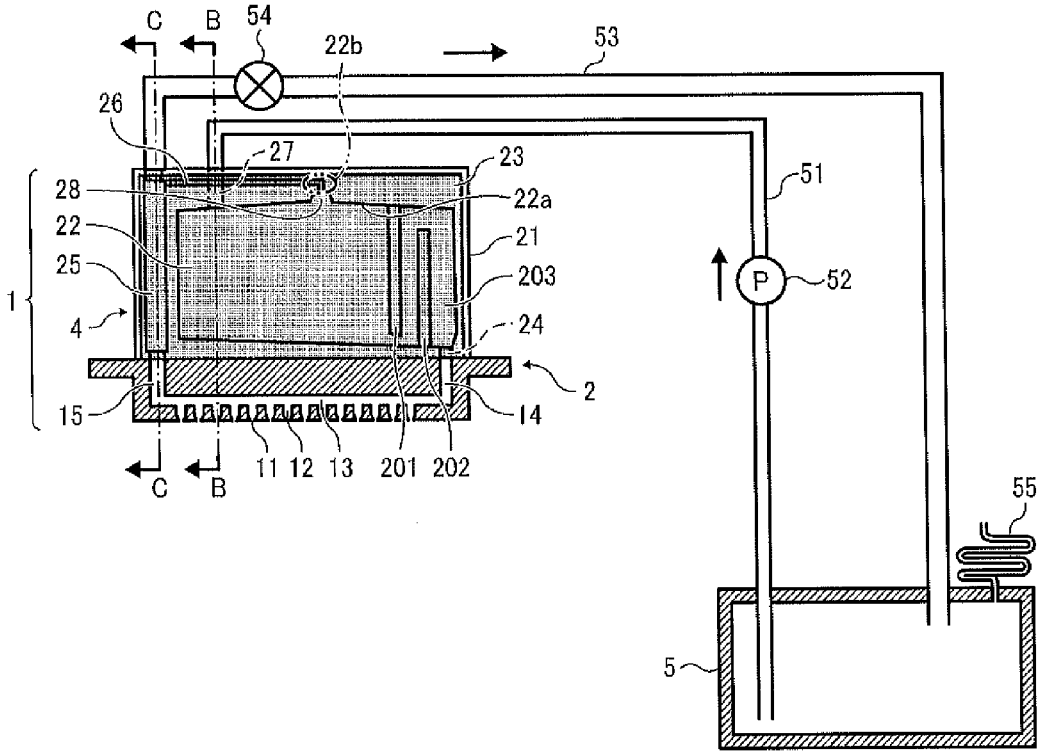
FIG. 8 illustrates an exemplary ink supply system that includes an ink ejection head unit according to the fourth embodiment of the present invention.
Figure 9:
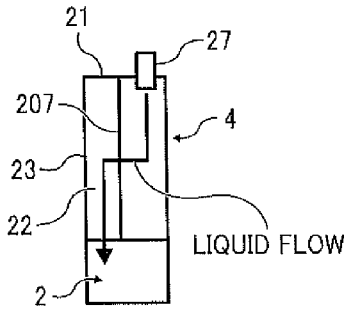
FIG. 9 illustrates an exemplary cross sectional view of the ink supply system of FIG. 8 along the line B-B.
Figure 10:
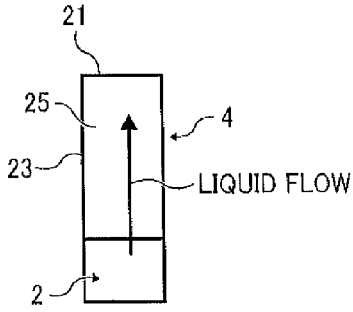
FIG. 10 illustrates an exemplary cross section of the ink supply system of FIG. 8 when viewed along the line C-C.

Now, the fourth embodiment is described with reference to FIGS. 8 to 10. As shown, a fourth embodiment includes the curved supply flow channel 203 of the third embodiment in the head unit 1 of the second embodiment. Further, a portion of the wall surfaces of the ink containing section 22, the supply flow channel 203, and the ink ejection path 25 are integrally formed by a sheet of damper member (e.g. a film member) 23. Thus, the structure can be more simplified.

Figure 11:
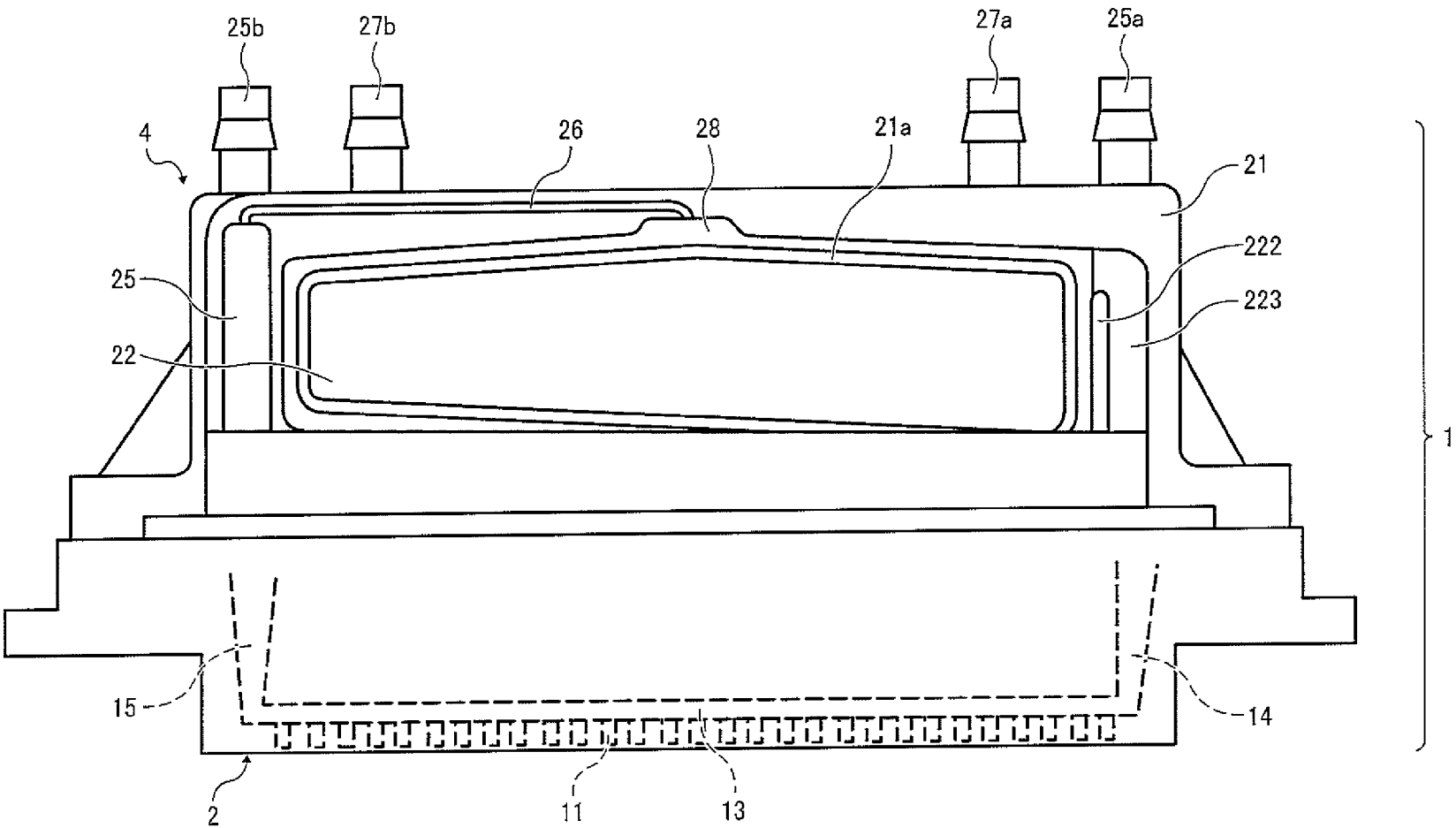
FIG. 11 illustrates an exemplary front side view of an ink supply system that includes an ink ejection head unit according to the fifth embodiment of the present invention.
Figure 12:
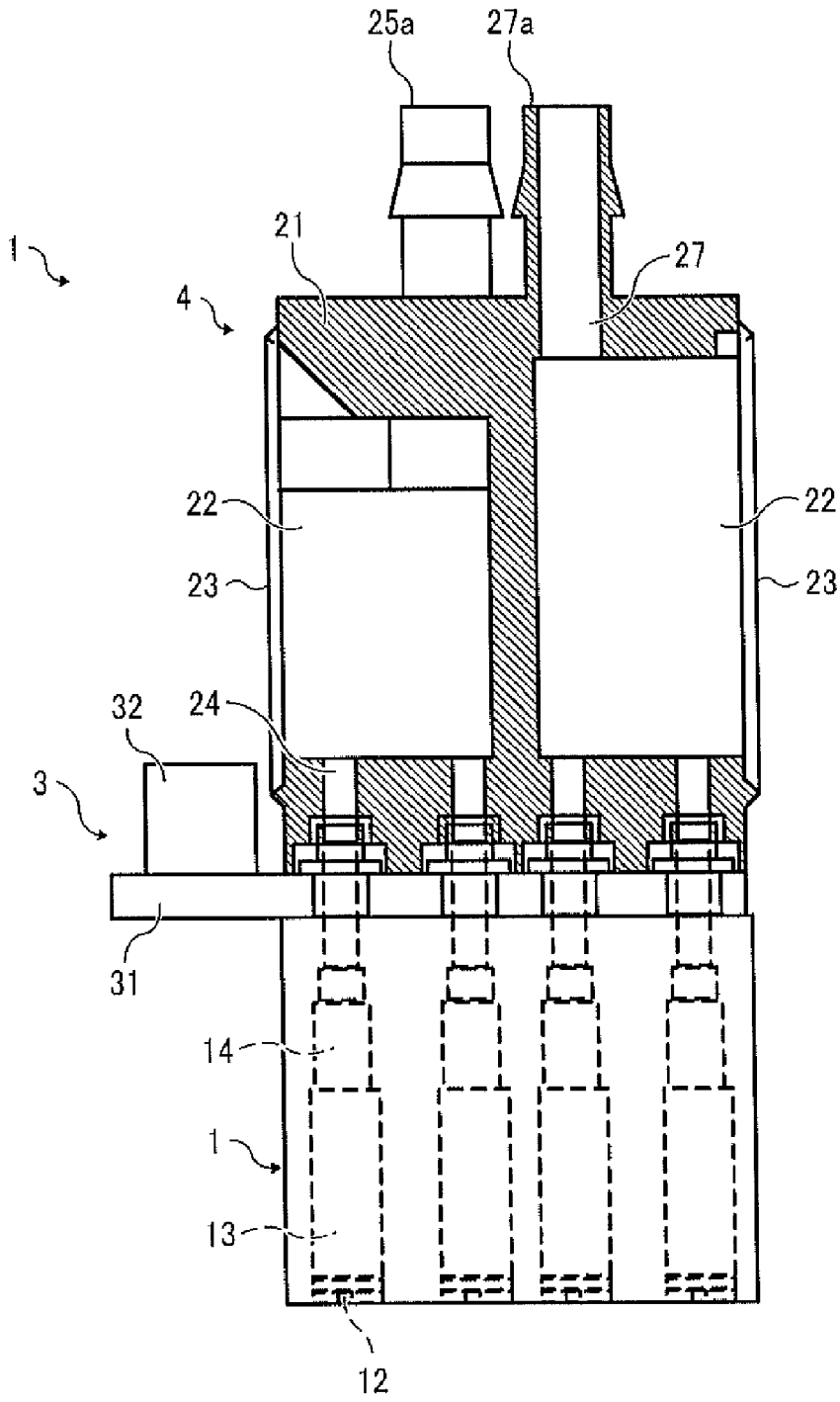
FIG. 12 illustrates an exemplary relevant part according to one embodiment of the present invention.
Figure 13:
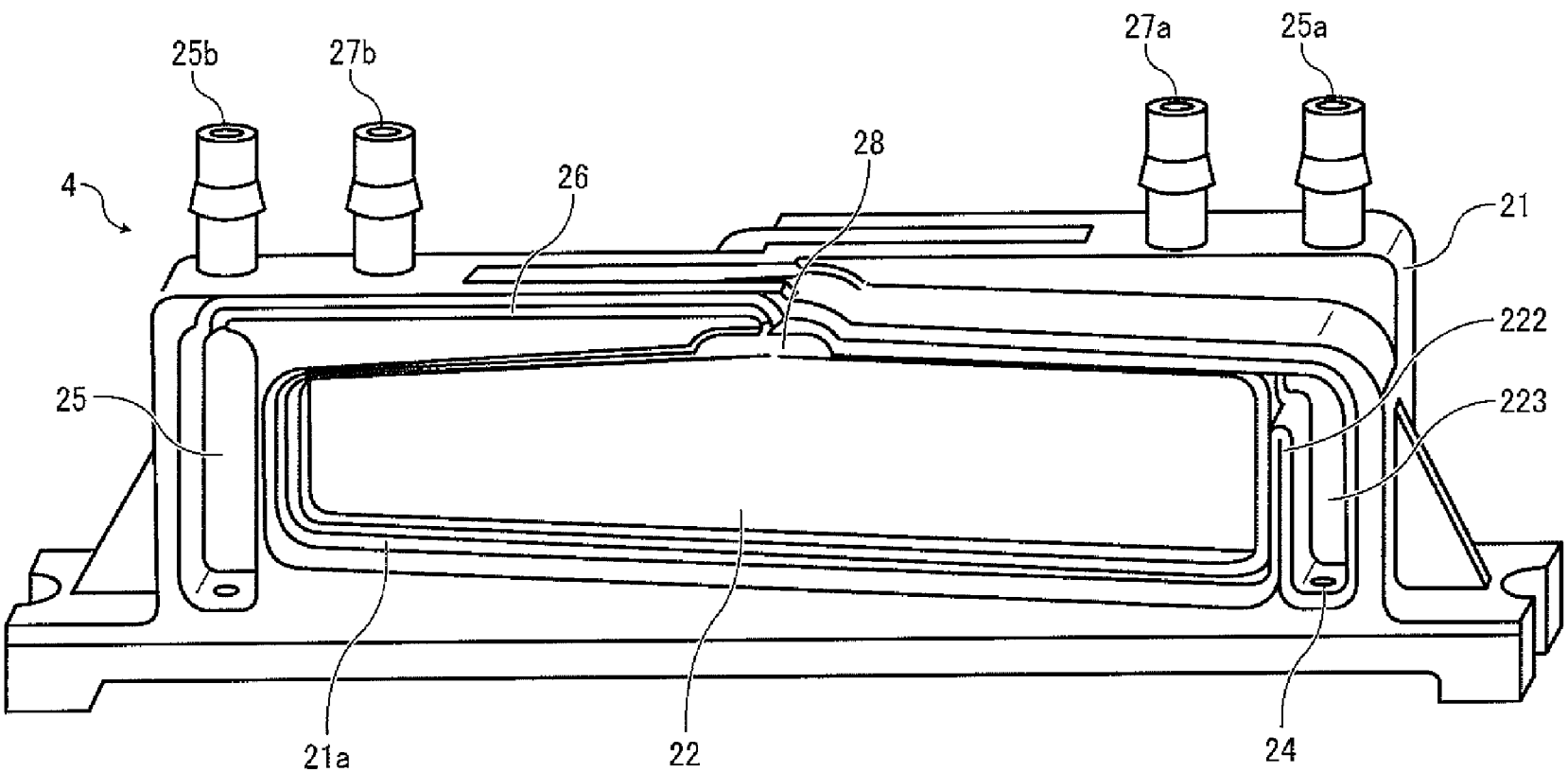
FIG. 13 schematically illustrates an exemplary sub tank employed in the ink ejection head unit according to one embodiment of the present invention.

Now, the fifth embodiment is described with reference to FIGS. 11 to 13. As shown, a head unit 1 of this embodiment includes an electric circuit substrate 3 between the head 2 and the sub tank 4 to support electronic parts connected to the head 2. Specifically, these head 2, the electric circuit substrate 3, and the sub tank 4 are integrated. The electric circuit substrate 3 includes a substrate body that supports a wired pattern, electronic parts, and connectors, not shown. Thus, mist can be suppressed from attracting to the electric circuit substrate 3.

Further, a supply flow channel 223 is formed by building a wall 222 between the supply path 24 and in the ink containing section 22 so as to connect the ink containing section 22 to the supply path 24. Further, a ringed rib 21*a* is formed in the ink containing section 22 to secure the filter member.

Further, nozzles make four lines. The sub tank 4 includes a pair of ink containing sections 22*a* and 22*b* connected to the main tank, not shown, via supply ports 27*a* and 27*b*, and ejection ports 25*a* and 25*b*, respectively. The remaining devices are the same as in the earlier mentioned embodiments.

Instead of the sheet, a printer medium, such as an OHP sheet, thread, texture, leather, plastic, glass, wood, ceramics, etc., capable of attracting ink drops or the like can be utilized. The image to be formed includes a meaningless image, such as a pattern, etc., beside a meaningful image, such as a character, a figure, etc. The ink includes every liquid, such as a DNA sample, resist, patter material, resin, etc., as called printing liquid, fixing processing liquid, general liquid or the like.

ADVANTAGE

According to one embodiment of the present invention, air bubble in a tank can be efficiently evacuated without arranging an atmosphere-opening device.

According to another embodiment of the present invention, image formation is precisely executed by a compact image forming apparatus. Obviously, numerous additional modifications and variations of the present invention are possible in light of the above teachings. It is therefore to be understood that within the scope of the appended claims, the present invention may be practiced otherwise than as specifically described herein.

What is claimed is:

1. An ink ejection head unit comprising:

a head configured to eject ink drops from at least two nozzles, said head including a common liquid chamber connected to the at least two nozzles, said common liquid chamber having a supply opening and an ejection opening; and a tank connected to the head, said tank including:

an ink containing section configured to contain ink to be supplied to the head, a supply path configured to supply the ink from the ink containing section to the supply opening, an ejection path configured to eject the ink ejected from the ejection opening to an outside of the ink ejection head unit, and a communication path configured to communicate the highest section of a seal of the ink containing section with a section of the ejection path higher than the highest section of the seal, wherein fluid resistance of the communication path is larger than the total fluid resistance of a path from the supply opening to the ejection opening.

2. The ink ejection head unit as claimed in claim 1, wherein said highest section of the seal is located substantially at a center of the tank.

3. The ink ejection head unit as claimed in claim 2, wherein said highest section of the seal includes an air bubble accumulation area configured to accumulate air bubbles.

4. The ink ejection head unit as claimed in claim 3, wherein said ink containing section includes:

a filter configured to filter the ink taken in from the outside;

an ink accumulation section configured to accumulate the ink filtered by the filter; and an ink supply path extending from the ink accumulation section to the supply path, wherein the ink accumulation section, the ink supply path, and the ejection path partially include elastic walls, respectively.

5. An image forming apparatus comprising:

a housing; and an image formation device having the ink ejection head unit as claimed in claim 4.

6. An ink ejection head unit comprising:

means for ejecting ink drops from at least two nozzles;

a common liquid chamber connected to the at least two nozzles, said common liquid chamber having a supply opening and an ejection opening;

means for containing ink to be supplied to the at least two nozzles;

means for supplying the ink from the ink containing means to the supply opening;

means for ejecting the ink via the ejection opening to an outside of the ink ejection head unit; and a communication path configured to communicate the highest section of a seal of the ink containing means with a portion of the ink ejection means located higher than the highest section of the seal, wherein a fluid resistance of the communication path is larger than the total fluid resistance of a path starting from the supply opening to the ejection opening.

7. The ink ejection head unit as claimed in claim 6, wherein said highest section of the seal is located substantially at a center of the tank.

8. The ink ejection head unit as claimed in claim 7, wherein said highest section of the seal includes an air bubble accumulation area configured to accumulate air bubbles.

9. The ink ejection head unit as claimed in claim 8, wherein said ink containing section includes:

a filter configured to filter the ink taken in from the outside;

an ink accumulation section configured to accumulate the ink filtered by the filter; and an ink supply path extending from the ink accumulation section to the supply path, wherein the ink accumulation section, the ink supply path, and the ejection path partially include elastic walls, respectively.

10. An image forming apparatus comprising:

a housing; and an image formation device having the ink ejection head unit as claimed in claim 9.

11. A method of ejecting ink and printing an image using an ink ejection head unit having a head including a common liquid chamber connected to at least two nozzles, and equipped with a supply opening and an ejection opening, a tank connected to the head and containing an ink containing section to contain ink to be supplied to the heads with a supply path in the ink containing section to supply the ink from the ink containing section to the supply opening and an ejection path that ejects the ink ejected from the ejection opening to an outside of the ink ejection head unit, the method comprising:

providing a communication path that communicates the highest section of a seal of the ink containing section with a portion of the ejection path located higher than the highest section of the seal;

adjusting a fluid resistance of the communication path to be larger than the total fluid resistance of a path starting from the supply opening to the ejection opening; and ejecting ink drops from the at least two nozzles.

* * * * *